United States Patent [19]

Sherman et al.

[11] Patent Number: 4,637,779

[45] Date of Patent: Jan. 20, 1987

[54] TWO STAGE MEDIUM CONSISTENCY PULP PUMPING

[75] Inventors: Michael I. Sherman, Glens Falls, N.Y.; Stefan Golston, Bellevue, Wash.

[73] Assignee: Kamyr, Inc., Glens Falls, N.Y.

[21] Appl. No.: 735,350

[22] Filed: May 17, 1985

[51] Int. Cl.[4] ..... F04D 1/10

[52] U.S. Cl. ..... 415/143; 415/199.6

[58] Field of Search ..... 415/121 R, 121 B, 142, 415/143, 199.1, 199.5, 199.6, 206, 190, 191, 199.1, 199.2, 199.4; 366/195, 196, 205, 314

[56] References Cited

U.S. PATENT DOCUMENTS

| | | | |
|---|---|---|---|
| 1,536,754 | 5/1925 | Benson | 415/190 |
| 2,378,372 | 6/1945 | Whittle | 415/199.5 X |
| 2,419,676 | 4/1947 | Curtis et al. | 415/143 X |
| 3,118,385 | 1/1964 | Yates | 417/424 |
| 3,241,493 | 3/1966 | Frey | 415/143 X |
| 3,286,641 | 11/1966 | Delao et al. | 415/199.5 X |
| 3,289,923 | 12/1966 | Millman | 415/199.3 |
| 3,384,022 | 5/1968 | Oshima | 415/143 |
| 3,677,659 | 7/1972 | Williams | 415/111 |
| 3,963,371 | 6/1976 | Sieghartner | 415/213 T X |
| 3,986,791 | 10/1976 | Paciga et al. | 415/219 C X |
| 4,101,243 | 7/1978 | Tatkov et al. | 415/201 |
| 4,190,395 | 2/1980 | Ball | 415/61 |
| 4,278,399 | 7/1981 | Erickson | 415/199.1 |
| 4,336,002 | 6/1982 | Rose et al. | 417/203 |
| 4,435,193 | 3/1984 | Gullichsen et al. | 415/204 X |
| 4,476,886 | 10/1984 | Niskanen et al. | 415/219 R X |
| 4,479,756 | 10/1984 | Sieghartner | 415/53 T |

FOREIGN PATENT DOCUMENTS

| | | | |
|---|---|---|---|
| 963540 | 7/1950 | France | 415/143 |
| 1128368 | 7/1982 | Japan . | |
| 791240 | 2/1958 | United Kingdom | 415/199.6 |

*Primary Examiner*—Edward K. Look
*Assistant Examiner*—Joseph M. Pitko
*Attorney, Agent, or Firm*—Nixon & Vanderhye

[57] ABSTRACT

A centrifugal pump for pumping suspensions having a consistency of about 6–20% (for example, for pumping paper pulp) has a second stage for increasing head. An auxiliary impeller is connected to the drive shaft in front of the main impeller, and upon rotation of the drive shaft directs the suspension being pumped axially into association with the main impeller. Mounted between the pump inlet and the auxiliary impeller are a plurality of stationary guide vanes, and mounted on the opposite side of the guide vanes from the auxiliary impeller are a plurality of prefluidizing vanes which are also connected to the drive shaft. The stationary guide vanes remove extreme prerotation of the suspension ahead of the auxiliary impeller, and change the turbulent and chaotic condition of the suspension into a directional flow at a definite angle of entrance. Utilizing the pump of the invention, there is no need to provide a vacuum system in order for the pump to operate properly.

21 Claims, 5 Drawing Figures

B
14
30
26
11
15
22
42
47
63
64
62
61
50
13
25
31
32
20
27
54
45
55
52
51
41
43
23
A
33
40
24
18
17
16
10
60

TWO STAGE MEDIUM CONSISTENCY PULP PUMPING

BACKGROUND AND SUMMARY OF THE INVENTION

The invention relates to a centrifugal pump, and a method of pumping medium consistency suspension in an effective manner. The invention is particularly applicable to the pumping of medium consistency finely comminuted cellulosic fibrous material suspensions (paper pulp), which should have a consistency of between about 6–20%.

Known pumps suitable for pumping medium consistency pulp are shown in U.S. Pat. Nos. 4,435,193 and 4,476,886, and in Canadian Patent 1,128,368. In use, these pumps are typically installed on the bottom of high density towers, are installed on the bottom or side or horizontal position in long chutes (e.g., 10 meters or greater), or are installed in short chutes. When the pumps are associated with high density towers or long chutes, sufficient head is provided so that the simplest form of pump (such as in Canadian Patent 1,128,368), which has no vacuum system, may be utilized. Such pumps operate very successfully. However, for pumps associated with short chutes, and for some other situations, the head is not sufficient so that a vacuum system is required, such as shown in U.S. Pat. No. 4,435,193.

While the medium consistency pulp pumps with vacuum systems, such as shown in U.S. Pat. No. 4,435,198, can operate successfully, operation is not simple either from an operating point of view or from a maintenance point of view. The vacuum control system has to be properly maintained in order to ensure successful operation. In practice what typically happens is that when the operator has difficulty in pumping higher consistency pulp, he adds dilution liquid and if the pump then works properly he leaves it running at the lower consistency. While the system then works, since it is working at a lower consistency than desired the advantages of pumping at the higher consistency are not achieved.

According to the present invention, a pump, and method of pumping, are provided which provide a significant boost in head so that basically the same pump as disclosed in Canadian Patent 1,128,368 and U.S. Pat. No. 4,476,886 can be utilized in short chutes, and other situations where a vacuum system is typically necessary, without need of a vacuum system.

According to the present invention, there is provided a method of pumping a suspension having a consistency of about 6–20%. The method comprises the steps of continuously acting upon the suspension to progressively: (a) Effect initial fluidization of the suspension. (b) Effect removal of extreme pre-rotation of the fluidized suspension and define a definite directional flow angle of the suspension. (c) Effect a first fluidizing pumping of the suspension moving in a definite directional flow, in a first stage, to pump the suspension directly to a second stage; and (d) effect a second fluidizing, centrifugal, pumping of the suspension at the second stage.

The pump according to the present invention, which allows the practice of the method of the invention, includes a housing having an inlet and an outlet, and a shaft mounted for rotation within the housing about an axis of rotation. A first set of impeller vanes are mounted to the shaft within the housing adjacent the housing inlet, and a second set of impeller vanes are mounted to the shaft within the housing between the first set and the outlet. The second set of vanes may be essentially identical to the construction of the impeller of a conventional pump for medium consistency pulp. A third set of vanes are also provided stationarily mounted to the housing between the inlet and the first set of vanes, and a fourth set of vanes are mounted to the shaft and extend out of the housing. The fourth set of vanes typically would contact pulp in a vessel above the pump housing to draw the pulp into the pump housing, and effect pre-fluidization of the pulp. The stationary vanes remove extreme pre-rotation of the suspension and define a definite directional flow angle of the suspension to the first set of impeller vanes. The first set of impeller vanes axially direct the pulp into contact with the second set of impeller vanes, which effect pumping of the pulp out of the pump housing outlet.

The operation of the pump according to the present invention is significantly improved compared to prior medium consistency pulp pumps. In the prior pumps, the pre-fluidizing vanes protrude into the chute about three inches, and have a 20°–30° helical angle to help draw the pulp into the pump inlet. However, part of the incoming stock, before it reaches the inlet, is thrown outwardly by a powerful centrifugal force. This incoming, and then laterally rejected stock, creates a continuous circulation, having a doughnut shape, around the periphery of the inlet, interfering with the incoming stock and thereby restricting the area of the free inlet. This causes, for a given GPN, higher velocity of the incoming pulp which in turn lowers the available NPSH and inlet pressure.

The stationary guide vanes in the pump according to the present invention, by removing the pre-rotation ahead of the impeller and changing the turbulent and chaotic condition of the stock into a directional flow into the impeller at a definite angle of entrance, provide greatly improved suction conditions and enhanced efficiency. The first set of impeller vanes can impart around a 40-foot additional head, for example, at 1,200 GPN and 2,000 RPM, and will require an additional 40-horsepower. This typically would be sufficient to allow elimination of the vacuum system in many situations.

The pump according to the present invention may easily be applied to situations where prior art medium consistency pumps have been utilized. All that is necessary to provide a pump according to the present invention, as opposed to the prior art pump, is to utilize a housing extension which attaches to the top part of the housing of the conventional pump, provide a longer shaft, and attach the first set of impeller blades to the shaft above the second set of impeller blades, and attach the stationary vanes to the housing upper part. The pre-fluidizing vanes may then be bolted, or otherwise connected, to the end of the shaft.

It is the primary object of the present invention to provide for the effective pumping of medium consistency pulp, and like suspensions. This and other objects of the invention will become clear from an inspection of the detailed description of the invention, and from the appended claims.

DETAILED DESCRIPTION OF THE DRAWINGS

Figure 1:
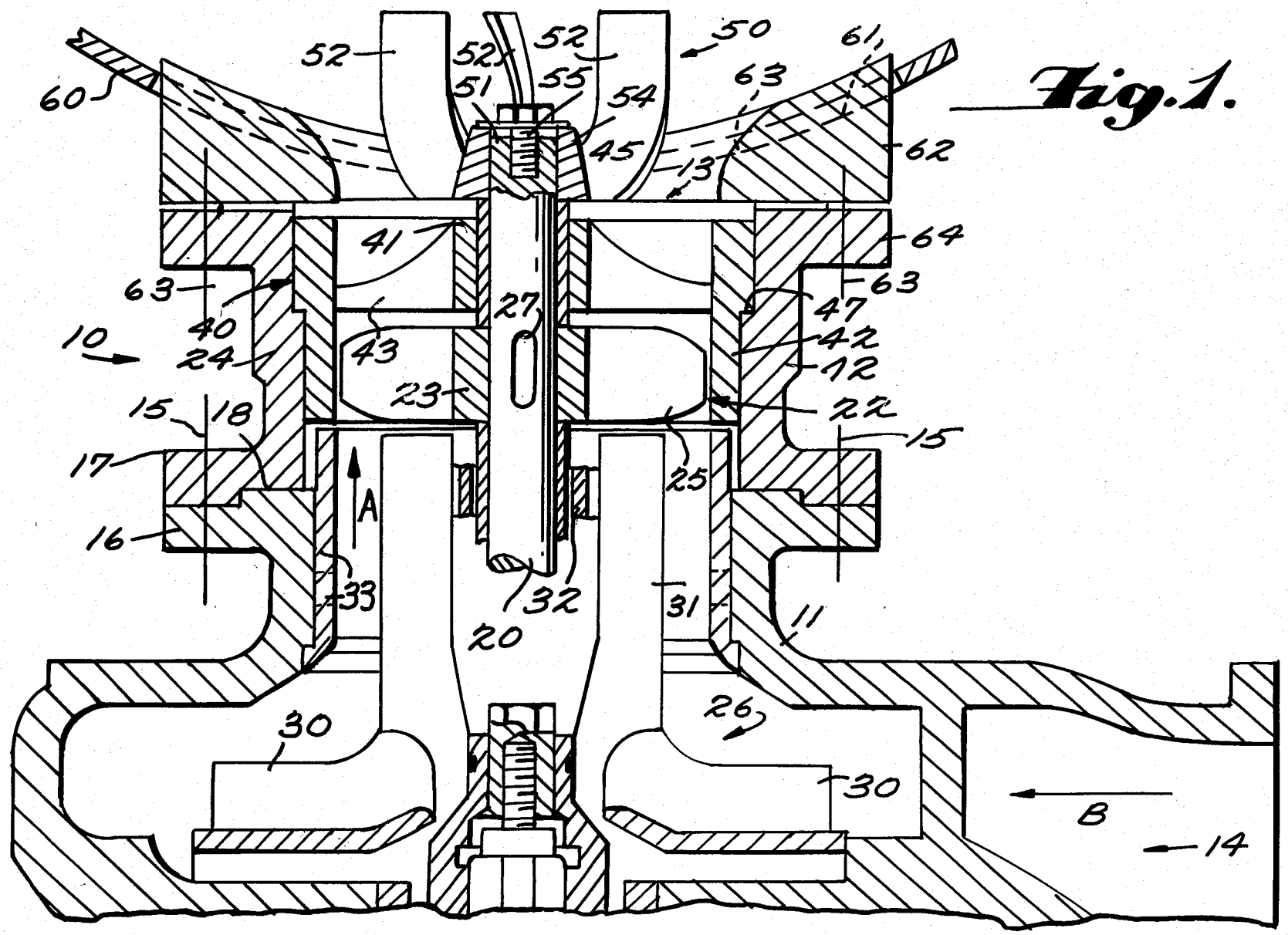
FIG. 1 side view, partly in crosssection and partly in elevation, of an exemplary centrifugal pump according to the present invention, shown in association with an opening in the bottom of a vessel containing suspension to be pumped.

An exemplary centrifugal pump according to the present invention is shown generally by reference numeral 10 in FIG. 1. The pump includes a housing defined by a first housing part 11 and a second housing part 12. An inlet, shown generally by reference numeral 13, is provided at one end of the housing, and an outlet 14 is also provided. The housing parts 11, 12 are elongated in a first dimension A, with the inlet 13 in line with the first dimension A. The outlet 14, on the other hand, extends in a second dimension B, substantially perpendicular to the first dimension A. The housing component parts 11, 12 are preferably bolted, or otherwise attached together, as by bolts extending at circumferentially spaced areas 15 thereof to attach annular flange portions 16, 17, together, with an annular seal 18 disposed between the flanges 16, 17.

A shaft 20 is elongated in the first dimension A, and is mounted for rotation about an axis concentric with the housing part 12 and extending in the dimension A. The shaft is mounted for rotation with respect to the housing 11, 12 by suitable conventional bearing means, and at the bottom (as viewed in FIG. 1) thereof is operatively connected to a motor or like shaft powering means. The bearing means and motor are conventional, and not illustrated in FIG. 1.

Figure 5:
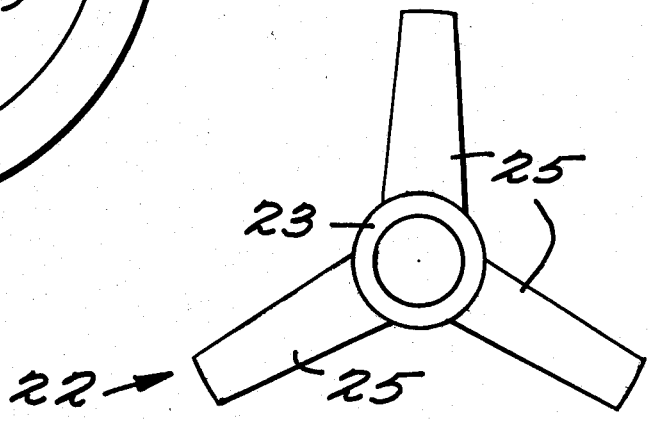
FIG. 5 is an axial plan view of the auxiliary impeller of the pump of FIG. 1.

Disposed within the interior cavity defined by the housing 11, 12 is a first set of impeller vanes, which are part of an auxiliary impeller unit shown generally by reference numeral 22 in FIG. 1, and also shown in FIG. 5. The auxiliary impeller unit 22 preferably comprises a central hub 23 which surrounds the shaft 20. The first set of vanes comprises the vanes 25 which extend outwardly from the hub 23. The vanes 25 extend generally radially, but are angled in such a way so as to cause a suspension passing through the inlet 13 of the housing 11, 12 to be pumped axially toward the main impeller 26. The hub 23 is affixed to the shaft by a conventional key 27, or other suitable structure.

Figure 3:
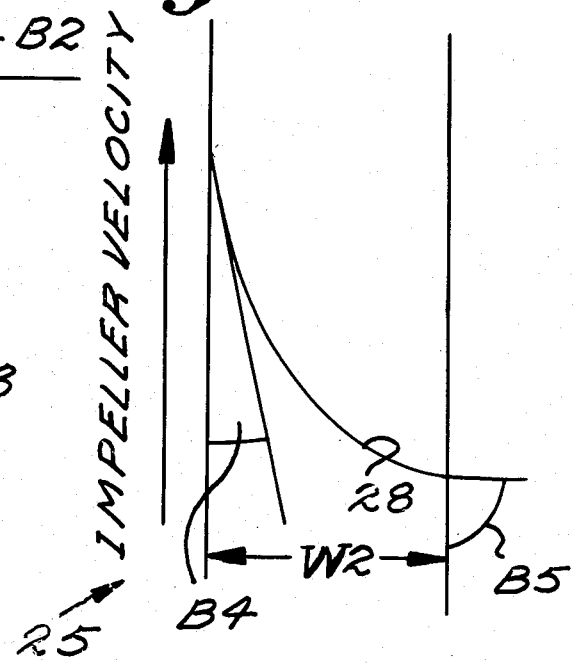

A typical profile for a vane 25 may be seen with respect to FIG. 3. In FIG. 3, the profile of the vane 25 is indicated by the line 28, and various angular relationships and dimensions are illustrated. In one particular embodiment of a useful impeller vane 25 according to the present invention, the angle B4 would be 5° at the periperhy and 14° at the hub, angle B5 would be 90° at the periphery and 90° at the hub, and the dimension W2 would be 2 inches at the hub. Of course, other configurations and angular relationships are possible depending upon the particular requirements since the angles and shape of the vanes depend on the size of the pump and its optimal operating conditions.

Mounted within the interior volume of the housing 11, 12 directly below the first set of vanes 25 is the main impeller 26, which includes a second set of vanes 30. The impeller 26, and vanes 30, can be conventional, such as illustrated in the previously mentioned Canadian and U.S. patents, and the vanes 30 are elongated generally in the dimension B and effect centrifugal pumping out the outlet 14 of suspension which comes in contact therewith. In order to accommodate the shaft 20, the upper portion of the main impeller 26 is different than the conventional impeller, the axially extending blades 31 being connected together adjacent the top portion thereof with a ring 32 which has an interior diameter greater than the diameter of the shaft 20. Also, the sleeve 33 preferably is disposed within the housing part 11 and extends upwardly into the housing part 12, the sleeve 33 having the same internal diameter as the internal diameter of the peripheral portion 42 (to be hereafter described). This provides for uniform positive flow of suspension from the auxiliary impeller 22 to the main impeller 26.

Figure 4:
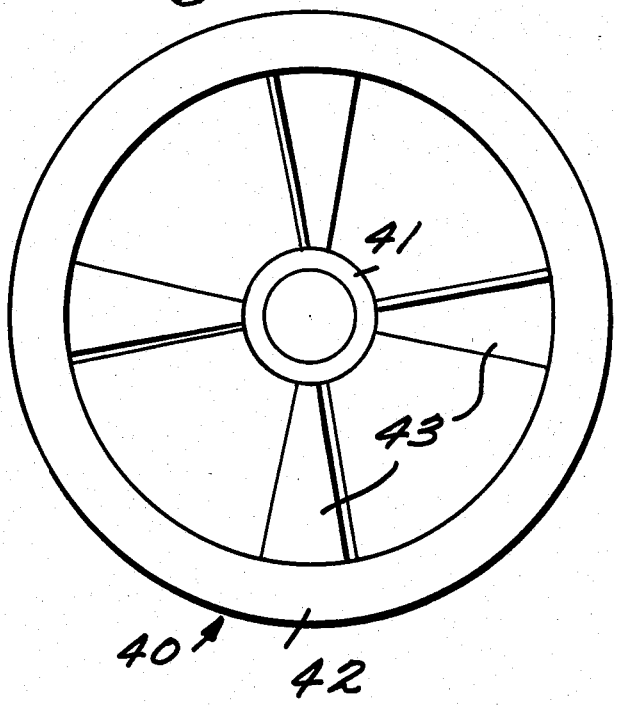
FIG. 4 is an axial view of the stationary guide vane component of the pump of FIG. 1.

For effective and efficient operation of the auxiliary impeller 22, according to the present invention a third set of vanes are provided within the housing 11, 12. This third set of vanes is part of a guide vane assembly identified generally by reference numeral 40 in FIGS. 1 and 4. The assembly 40 includes a hub 41, an annular peripheral member 42, and the third set of vanes, the vanes 43, extending generally radially between the hub 41 and the peripheral member 42. The hub 41 includes a water lubricated bearing 45 held therein, which receives the shaft 20 thus providing support for it at the end thereof opposite the impeller 26. The vanes 43 are stationarily mounted within the housing 11, 12 by welding, or otherwise attaching, the annular peripheral member 42 at the inlet 13 to the housing 11, 12. See the member 42 engaging the annular shoulder portion 47 (FIG. 1) of the housing second part 12.

Figure 2:
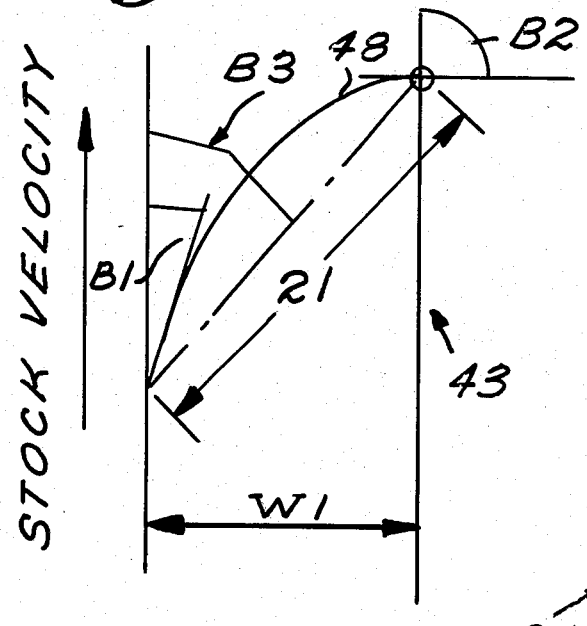
FIGS. 2 and 3 are schematic profile details of exemplary stationary vanes, and suction booster impeller vanes, respectively.

The vanes 43 are specifically contoured so that they comprise means for removing extreme prerotation from the suspension as it enters the inlet 13, which pre-rotation is imparted to the suspension by the fourth set of vanes 50. Also, the stationary vanes 43 change the turbulent and chaotic condition of the suspension at the inlet 13 into a directional flow into the impeller 22 at a definite angle of entrance. A typical stationary vane 43 contour may be seen with respect to FIG. 2, wherein the profile of a typical vane 43 is illustrated by reference numeral 48. In an exemplary embodiment of the present invention (cooperating with the exemplary embodiment of the impeller blades 25 described above), the angle B1 would be 10° at the periphery and 14° at the hub, the angle B2 would be 90° at both the hub and the periphery, the angle B3 would be 27° at the periphery and 56° at the hub, the dimension L1 would be 5 inches at the periphery and 2.7 inches at the hub, and the dimension W1 would be 2¼ inches at both the periphery and the hub. Other angular relationships and dimensions are possible depending upon the particular use and capacity of the pump 10, the above specific recitations being merely exemplary.

The fourth set of vanes 50 are mounted to the end 51 of the shaft 20 remote from the main impeller 26, and preferably comprise three or four vanes 52 which extend axially and have a helical angle so as to help draw suspension into the inlet 13. This fourth set of vanes 50 can be considered a "pre-fluidizer". Typical pre-fluidizer blades in conventional medium consistency pulp pumps have a helical angle of between about 20°-30°. The vanes 50 preferably have a helical angle of about 30°. The vanes 52 are interconnected by a hub 54, which fits on the end 51 of the shaft 20, abuts bearing sleeve 45, and is held in place by bolt 55 or a like fastening structure.

In order to prevent repetitious resonance, it is highly desirable to provide a different number of vanes for the impeller 22 than for the stationary guide vane assembly 40. Preferably, the number of vanes 43 is X, wherein X is a positive integer equal to or greater than 4, and the number of vanes 25 is Y, wherein Y is a positive integer greater than or equal to 3, and wherein X is not equal to Y, or an even multiple of Y. Also numbers having common divisor should preferably be avoided. For instance if X equals 4, then Y may equal 3, 5, or 7, but not 4, 6 or 8. In a preferred embodiment, there are four (4) stationary guide vanes 43, and three auxiliary impeller vanes 25.

In the most common use of the pump 10 according to the present invention, in the pumping of medium consistency (i.e., about 6–20%) finely comminuted cellulosic fibrous suspensions (i.e., paper pulp), the pump 10 is located in association with a vessel 60, such as a chute, tank, or the like. In the exemplary embodiment illustrated in FIG. 1, the vessel 60 is a vertically disposed vessel with the pump 10 disposed at the bottom thereof, and with the dimension A being vertical. An opening, 61, is provided at the bottom of the vessel 60, the opening 61 being essentially concentric with the inlet 13 to the pump 10. The suction bell 62, having a tapered arcuate interior surface 63 to facilitate appropriate flow of the suspension into the inlet 13, is welded or otherwise attached to the vessel 60 within the opening 61. The pump second housing part 12 is then bolted, as by bolts extending at a plurality of circumferentially spaced positions 63, to the suction bell 62, the bolts at position 63 extending through upper flange 64 of the second housing part 12 into interiorly threaded openings of the suction bell 62.

While the invention has been described with the shaft 20 having a vertical orientation, a wide variety of other orientations are possible. For instance in one common structure the structure 60 is part of the circular side wall of a chute, with the axis 20 being essentially horizontal.

Operation

In a preferred use of the pump 10 according to the present invention, a shaft 20 is rotated by a motor so that the shaft connected vanes move fast enough to effect fluidization of the pulp (as described in the previously mentioned Canadian and U.S. patents). Pre-fluidization of the suspension is effected by the vanes 52, which draw the suspension from the interior of the vessel 60 downwardly into the inlet 13. The contoured surface 63 of the suction bell 62 facilitates desirable flow of the suspension toward the inlet 13, although at this point the suspension may be considered to be in a truly turbulent and chaotic condition. However, the suspension then impacts upon the stationary guide vanes 43, which effect removal of extreme pre-rotation of the fluidized suspension, and define a definite directional flow angle of the suspension towards the auxiliary impeller 22. The rotating vanes 25 effect pumping of the suspension axially within the housing 11, 12, directly to the main impeller 26, there being no intervening stationary components within the housing 11, and the vanes 25 move at the same speed as shaft 20 and ensure axial pumping of the pulp, adding pressure head. The rotating impeller vanes 30, and blades 31, effect another fluidization of the suspension and centrifugal pumping of the suspension out the outlet 14.

It will be seen that the utilization of the pump 10 is relatively simple since it can be connected to conventional medium consistency pulp pump housings which are comparable to the first housing part 11. The second housing part 12, which may be considered a housing extension, is merely bolted onto the conventional housing 11, the auxiliary impeller 22 is keyed to the new, longer shaft 20 by slipping the hub 23 over the end 51 of the shaft, and inserting the appropriate key; and the guide vane assembly 40 is moved into place by slipping it, and water lubricated bearing 45, over the free end 51 of the shaft 20, and tack welding it to part 12 adjacent flange 64. Then the hub 54 is moved onto the end 51 of the shaft 20 and bolted in place with bolt 55, and then the upper annular flange 64 of the housing part 12 may be bolted to the suction bell 62, and the pump is ready for operation.

It will thus be seen that according to the present invention an effective method and apparatus have been provided for increasing the suction pressure to a centrifugal fluidizing pump for pumping medium consistency suspensions.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of pumping a suspension having a consistency between about 6–20%, comprising the step of continuously acting upon a suspension to progressively (a) effect initial fluidization of the suspension;

(b) effect removal of extreme pre-rotation of the fluidized suspension, and define a definite directional flow angle of the suspension;

(c) effect a first fluidizing pumping of the suspension, in a first stage, to pump the suspension directly to a second stage; and (d) effect a second fluidizing centrifugal pumping of the suspension in the second stage.

2. A method as recited in claim 1 wherein during the practice of steps (a)–(c), the suspension is moved with a primary vector in a first dimension, and wherein after the practice of step (d) the suspension is moved with a primary vector in a second dimension perpendicular to the first dimension.

3. A method as recited in claim 2 comprising the further step, prior to step (a), of storing the suspension is a vessel; and wherein step (a) takes place in the vessel and simultaneously effects movement of suspension out of the vessel with a primary vector in said first dimension.

4. A method as recited in claim 3 wherein step (b) is practiced by causing a suspension to move past a plurality of stationary guide vanes.

5. A method as recited in claim 1 wherein the suspension comprises a suspension of finely comminuted cellulosic fibrous material.

6. A method as recited in claim 1 wherein steps (a)–(c) impart approximately about a 40-foot head at the second stage.

7. A centrifugal pump for fluent material comprising:

a housing having an inlet and an outlet;

a shaft mounted for rotation within said housing about an axis of rotation;

a first set of vanes mounted to said shaft within said housing adjacent said inlet;

a second set of vanes mounted to said shaft within said housing between said first set of vanes and said outlet;

a third set of vanes stationarily mounted to said housing between said inlet and said first set of vanes, said third set of vanes comprising means for removing extreme prerotation of fluent material passing therethrough; and means for effecting rotation of said shaft and said first and second sets of vanes with respect to said housing.

8. A pump as recited in claim 7 further comprising a fourth set of vanes mounted to said shaft and disposed outside of said housing, said fourth set of vanes on the opposite side of said third set of vanes from said first set of vanes.

9. A pump as recited in claim 8 wherein the means for removing extreme pre-rotation of fluent material also defines a definite directional flow angle of the fluent material from the inlet to the first set of vanes.

10. A pump as recited in claims 9 wherein said housing presents no intervening stationary structure between said first set of vanes and said second set of vanes, and wherein said first set of vanes comprises means for pumping fluent material directly to said second set of vanes, with a primary vector extending axially.

11. A pump as recited in claim 10 wherein said third set of vanes comprises X vanes, wherein X is a positive integer 4 or greater, and wherein said first set of vanes comprises Y vanes, wherein Y is a positive integer 3 or greater, and wherein X is not equal to Y or an even multiple of Y.

12. A pump as recited in claim 7 wherein said third set of vanes extends between a hub and a peripheral member, said peripheral member affixed to said housing, and said hub comprising a bearing for said shaft.

13. A pump as recited in claim 7 wherein said housing comprises first and second parts connected together, said first part including said outlet and containing said second set of vanes therein, and said second part of said housing defining said inlet and containing said first and third set of vanes therein, said third set of vanes operatively rigidly connected to said housing second part.

14. A two stage centrifugal pump comprising:

a housing elongated in a first dimension and having an inlet at one end thereof disposed in line with said first dimension, and having an outlet extending in a second dimension substantially perpendicular to said first dimension; said housing defining a single central cavity extending from said inlet to said outlet;

a shaft elongated in said first dimension and mounted for rotation in said housing about an axis extending in said first dimension and substantially concentric with said inlet;

a first set of vanes mounted to said shaft for rotation therewith, mounted within said housing adjacent said inlet, and for moving fluent material pumped thereby axially and away from said inlet; and a second set of vanes mounted to said shaft for rotation therewith, mounted within said housing remote from said inlet and having a portion thereof elongated in said second dimension and disposed adjacent said outlet; said housing presenting no intervening stationary structure between said first and second sets of vanes; and a third set of vanes stationarily mounted to said housing between said inlet and said first set of vanes, said third set of vanes comprising means for removing extreme prerotation of fluent material passing therethrough.

15. A pump as recited in claim 14 further comprising a fourth set of vanes mounted to said shaft and disposed outside of said housing, said fourth set of vanes on the opposite side of said third set of vanes from said first set of vanes.

16. A pump as recited in claim 15 wherein the means for removing extreme pre-rotation of fluent material generated also defines a definite directional flow angle of the fluent material from the inlet to the first set of vanes.

17. A pump as recited in claim 14 wherein said third set of vanes extends between a hub and a peripheral member, said peripheral member affixed to said housing, and said hub comprising a bearing for said shaft.

18. A pump as recited in claim 15 wherein said housing is operatively connected to a vessel so that said inlet is in communication with an opening in said vessel; and further comprising a suction bell disposed in said vessel opening and immediately adjacent said housing inlet.

19. A pump as recited in claim 18 wherein said fourth set of vanes extends into the interior of the vessel above the suction bell, and wherein said vanes of said fourth set of vanes are angled so as to draw material from the vessel into the housing inlet upon rotation of said shaft.

20. A pump as recited in claim 19 wherein said housing comprises first and second housing parts, said first housing part including said outlet and containing said second set of vanes therein, and said second housing part connected between said suction bell and said first housing part, and containing said first and third set of vanes therein, said third set of vanes operatively rigidly connected to said second housing part.

21. A pump as recited in claim 14 wherein said third set of vanes comprises X vanes, wherein X is a positive integer 4 or greater, and wherein said first set of vanes comprises Y vanes, wherein Y is a positive integer 3 or greater, and wherein X is not equal to Y or an even multiple of Y.

* * * * *